US011009237B2

(12) United States Patent
Kim et al.

(10) Patent No.: US 11,009,237 B2
(45) Date of Patent: May 18, 2021

(54) DOWNDRAFT AIR CLEANING UNIT AND COOKING SYSTEM HAVING THE SAME

(71) Applicant: LG ELECTRONICS INC., Seoul (KR)

(72) Inventors: Wan Soo Kim, Seoul (KR); Yangkyeong Kim, Seoul (KR); Woo Jin Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 160 days.

(21) Appl. No.: 15/962,325

(22) Filed: Apr. 25, 2018

(65) Prior Publication Data

US 2018/0313546 A1 Nov. 1, 2018

(30) Foreign Application Priority Data

Apr. 26, 2017 (KR) ..... 10-2017-0053989

(51) Int. Cl.
*F24C 15/20* (2006.01)

(52) U.S. Cl.
CPC ..... *F24C 15/2042* (2013.01); *F24C 15/2035* (2013.01); *F24C 15/2092* (2013.01)

(58) Field of Classification Search
CPC .. F24C 15/2042; B66F 7/0658; B66F 7/0666; B66F 7/06; B66F 7/0633; B66F 7/0641; B66F 7/065
See application file for complete search history.

(56) References Cited

U.S. PATENT DOCUMENTS

| | | | | |
|---|---|---|---|---|
| 5,943,790 | A * | 8/1999 | Gell, Jr. | A23N 12/12 34/360 |
| 6,821,318 | B2 * | 11/2004 | Khosropour | B01D 47/021 95/226 |
| 2002/0029696 | A1 * | 3/2002 | Grimm | F24C 15/2042 99/403 |
| 2007/0247977 | A1 * | 10/2007 | Kaneko | F16M 11/10 368/190 |
| 2014/0034040 | A1 | 2/2014 | Sinur et al. | |
| 2014/0041649 | A1 * | 2/2014 | Sinur | F24C 15/2042 126/299 D |
| 2016/0137225 | A1 * | 5/2016 | Tarum | B62D 15/0235 701/41 |
| 2017/0016630 | A1 * | 1/2017 | Yang | F24C 15/2042 |

FOREIGN PATENT DOCUMENTS

| | | | |
|---|---|---|---|
| CN | 2365550 | Y | 2/2000 |
| CN | 201088506 | Y | 7/2008 |
| CN | 104412042 | A | 3/2015 |
| DE | 3503236 | A1 | 8/1986 |
| JP | 2015-506742 | A | 5/1999 |
| KR | 20-0133284 | A | 5/1999 |
| KR | 10-1486725 | B1 | 1/2015 |

* cited by examiner

*Primary Examiner* — Jason Lau
(74) *Attorney, Agent, or Firm* — Birch, Stewart, Kolasch & Birch, LLP

(57) ABSTRACT

An air cleaning unit includes a suction part into which contaminated air flows, a transfer body coupled with the suction part to support the suction part and to be raised up and down with the suction part; an elevation part connected to the transfer body and raising up and down the transfer body, a pivoting part connected to the suction part to pivot the suction part, and a filtering part communicating with the suction part and cleaning the contaminated air introduced into the suction part.

11 Claims, 4 Drawing Sheets

DOWNDRAFT AIR CLEANING UNIT AND COOKING SYSTEM HAVING THE SAME

CROSS-REFERENCE TO RELATED APPLICATIONS

This application claims priority to Korean Patent Application No. 10-2017-0053989, filed on Apr. 26, 2017, in the Korean Intellectual Property Office, the disclosure of which is hereby incorporated by reference in its entirety.

BACKGROUND

1. Technical Field

The present disclosure relates to a downdraft air cleaning unit and a cooking system including the same. More specifically, the present disclosure relates to a downdraft air cleaning unit capable of efficiently sucking contaminated air generated during cooking, including a suction part that is raised up and down and that pivots, thereby increasing the efficiency of space utilization and providing convenience of operation while preventing contamination.

2. Description of the Related Art

Typically, a ventilation hood is installed above a cooking appliance such as a gas range, for forcibly sucking the odor and heat generated during cooking, and for discharging them to the outside.

More specifically, a cabinet is typically installed on the upper side of a wall, and a gas range is placed on the lower side of the wall. A ventilation case with a ventilation fan is installed above the gas range. Further, a flexible pipe is fixed to the top of the ventilation case, and the flexible pipe is inserted into an exhaust port.

When the ventilation fan installed inside the ventilation case is operated when cooking using the gas range, the heat generated in the gas range and the smells generated when the food is cooked move upward, and are discharged to the outside via the flexible pipe and the exhaust port.

Unfortunately, such an existing ventilation hood has problems in that it requires a large space for installation and deteriorates the appearance of the kitchen.

To improve this, a downdraft range hood has been proposed. The downdraft range hood includes a fan motor, such that the contaminated air generated in the gas range is guided to the downward direction of the gas range as the fan is operated, and the air is filtered and then discharged to the outside.

However, the downdraft type range hood also has problems in that it is exposed above the cooking unit and thus occupies a large space even when it is not in use, and that it also deteriorates the appearance of the kitchen.

In addition, the existing range hood is exposed above the cooking unit even when it is not in use, and thus it may be contaminated by oil stains generated during cooking or as food is spattered. Therefore, it is not hygienic, is very troublesome to clean, and has a problem of shortening the life time of the range hood.

In addition, the suction part of the existing range hood is stationary and accordingly it cannot efficiently suck contaminated air generated during cooking if the air is moving.

Further, a lamp is disposed on the existing hood for checking the doneness of food. The lamp is positioned such that it protrudes toward a cooking appliance for a close look. Accordingly, even when the range hood is not in use, the hood and the protruding position of the lamp interfere with the cooking. Further, there is a problem in that the lamp is fixed only at a specific position, such that it cannot provide efficient illumination.

SUMMARY

It is an object of the present disclosure to provide a downdraft air cleaning unit that is accommodated in a cooking unit while it is not in use, and is exposed only when it is in use, thereby preventing contamination, utilizing space more efficiently, and improving the service life.

It is another object of the present disclosure to provide a downdraft air cleaning unit having a suction part which can pivot along the direction in which the contaminated air flows to thereby efficiently suck the air.

It is another object of the present disclosure to provide a downdraft air cleaning unit in which a lighting device used for checking the doneness of food is mounted on the suction part that can pivot, which allows for efficient lighting and does not disturb cooking when it is not in use.

It is another object of the present disclosure to provide a cooking system in which an air cleaning unit, including a suction part that can be raised up and down and pivoted, is accommodated in a cooking unit that includes an energy supply module, thereby allowing for efficient cooking and air cleaning.

Objects of the present disclosure are not limited to the above-described objects, and other objects and advantages can be appreciated by those skilled in the art from the following descriptions. Further, it will be easily appreciated that the objects and advantages of the present disclosure can be practiced by means recited in the appended claims and a combination thereof.

According to an exemplary embodiment of the present disclosure, an air cleaning unit includes an elevation part for raising and lowering a suction part. Accordingly, the elevation part raises the suction part during an air cleaning operation and lowers the suction part to accommodate it into the cooking unit when it is not in use, thereby preventing contamination and increasing the efficiency of space utilization.

The air cleaning unit may include a pivoting part for pivoting the suction part. Accordingly, the pivoting part allows the suction part to pivot toward the direction in which contaminated air flows, thereby improving the efficiency of sucking the contaminated air.

The air cleaning unit may include a lighting device mounted on the suction part that can pivot. Accordingly, the lighting device can be operated efficiently, and it does not disturb cooking when it is not in use.

According to an exemplary embodiment of the present disclosure, an energy supply module is mounted on a cooking unit, and an air cleaning unit, including a suction part that can be raised up and down and pivoted, is accommodated in the cooking unit. Accordingly, cooking can become efficient, and air can be cleaned.

According to an exemplary embodiment of the present disclosure, a suction part for sucking contaminated air generated during cooking is accommodated in a cooking unit when it is not in use and comes up when it is in use, such that it does not disturb cooking when it is not in use and increases the efficiency of space utilization.

In addition, according to an exemplary embodiment of the present disclosure, because the suction part is accommodated in a cooking unit and comes up only when it is in use, it is possible to prevent contamination and thus provide a suction part that is hygienic, avoids troublesome cleaning, and improves user convenience.

In addition, according to an exemplary embodiment of the present disclosure, the suction part pivots toward the direction in which contaminated air flows, such that it is possible to efficiently suck the contaminated air to thereby improve cleaning efficiency.

Further, according to an exemplary embodiment of the present disclosure, an air cleaning unit is provided in which a lighting device for checking doneness of food is mounted on the suction part that can pivot, thereby improving the lighting efficiency without disturbing cooking when it is not in use.

According to an exemplary embodiment of the present disclosure, a cooking system is provided in which an air cleaning unit, that includes a suction part that can raise up and down and pivot, is accommodated in a cooking unit on which an energy supply module is mounted, thereby allowing for efficient cooking and air cleaning.

In addition to the above-described effects, specific effects of the present disclosure will be described together with embodiments to be described below.

DETAILED DESCRIPTION

Terms and words used in the present specification and claims are not to be construed as a general or dictionary meaning but are to be construed meaning and concepts meeting the technical ideas of the present invention based on a principle that the inventors can appropriately define the concepts of terms in order to describe their own inventions in the best way. Therefore, while the present invention is described with reference to the certain particular embodiments and the accompanying drawings, it is to be understood that the embodiments are merely illustrative and various equivalents and modifications are possible without departing from the spirit and scope of the present disclosure as defined in the following claims.

Figure 1:
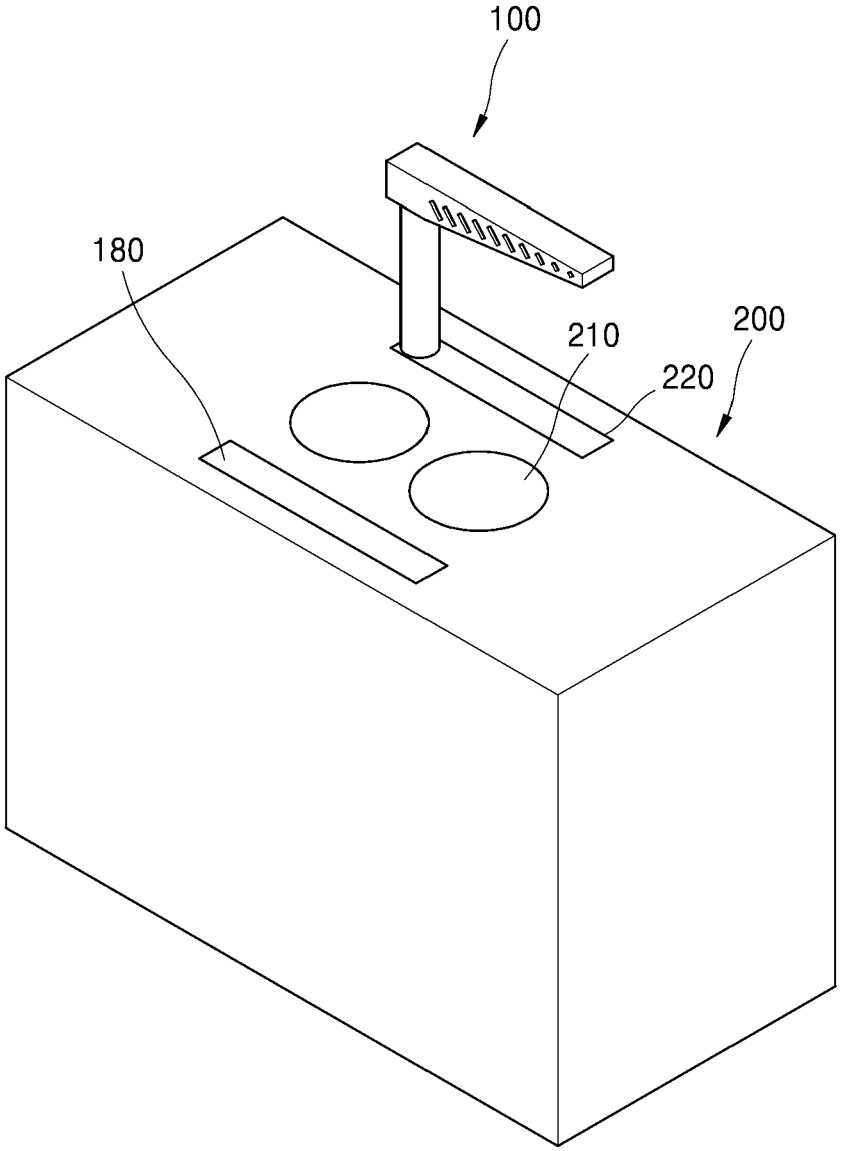
FIG. 1 is a view schematically showing a downdraft air cleaning unit according to an exemplary embodiment of the present disclosure mounted on a cooking unit.

FIG. 1 is a view schematically showing a downdraft air cleaning unit according to an exemplary embodiment of the present disclosure mounted on a cooking unit.

As shown in FIG. 1, a downdraft air cleaning unit 100 is mounted on a cooking unit 200 equipped with heating devices 210.

The air cleaning unit 100 is normally accommodated in the cooking unit 200, and is raised and comes up out of the cooking unit 200 for an air cleaning operation.

The air cleaning unit 100 may pivot toward the heating devices 210 of the cooking unit 200.

The air cleaning unit 100 may be operated by a user interface 180, which includes a controller.

That is, the air cleaning unit 100 according to the exemplary embodiment of the present disclosure includes an elevating mechanism and a pivoting mechanism. The air cleaning unit 100 is accommodated in the cooking unit 200 when it is not in use, comes out of the cooking unit 200 only when it is in use, and pivots toward the direction of a contaminated air flow or the heating devices 210 for increasing the sucking efficiency.

Hereinafter, the specific configuration, combination between elements and operation of the downdraft air cleaning unit according to an exemplary embodiment of the present disclosure will be described in more detail with reference to FIGS. 2 to 4.

Figure 2:
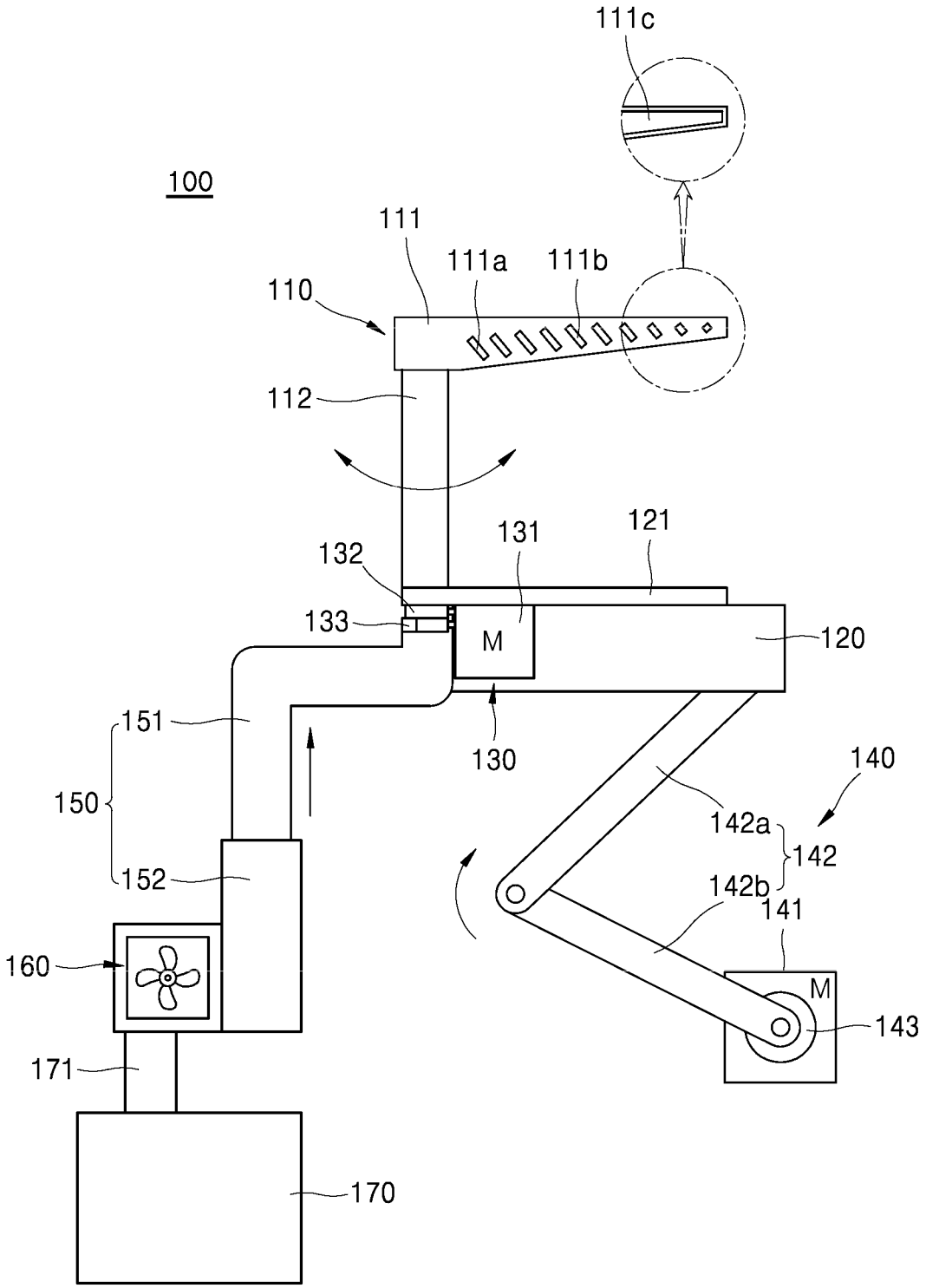
FIG. 2 is a view schematically showing the downdraft air cleaning unit shown in FIG. 1.

FIG. 2 is a view schematically showing the downdraft air cleaning unit shown in FIG. 1.

As shown in the drawings, the air cleaning unit 100 includes a suction part 110, a transfer body 120, a pivoting part 130, an elevation part 140, a connecting duct unit 150, a fan motor 160, a filtering part 170, and a user interface 180 (see FIG. 1).

More specifically, the suction part 110 sucks contaminated air, that is, unpleasant odor generated during cooking or air containing oil components, and includes a suction part body 111 and a supporting body 112.

In addition, inlet holes 111*a* for sucking contaminated air are formed in the suction part body 111, and filters 111*b* for firstly cleaning the contaminated air are included in the suction part body 111. The filters 111*b* may cover the inlet holes 111*a* or may be positioned to face the inlet holes 111*a*.

In addition, a lighting device 111*c* used for checking the doneness of food may be mounted at the lower part of the suction part body 111, as shown in the bottom view of FIG. 2 represented within the dot-dash broken line circles.

The supporting body 112 is configured to permit a flow of contaminated air therethrough that is sucked from the suction part body 111, and to support the suction part body 111.

To this end, the supporting body 112 is formed in a cylindrical shape and communicates with the inlet holes 111*a*. An upper end of the supporting body 112 is coupled under one end of the suction part body 111, and a lower end of the supporting body 112 is pivotably supported by the transfer body 120.

Further, since the supporting body 112 supports only one side of the suction part body 111, the suction part 110 does not occupy much space even when it is raised.

The suction part 110 is coupled to the transfer body 120 such that the transfer body 120 is raised with the suction part 110 supported. The transfer body 120 also covers an accommodating space 220 (see FIG. 1) of the cooking unit when the suction part 110 is raised to its highest position.

To this end, a cover plate 121 conforming to the accommodating space is formed in the transfer body 120 so that the cover plate 121 covers the accommodating space 220 when the suction part 110 is raised to its highest position, to provide a more refined appearance and to prevent food or other items from inadvertently falling into the accommodation space when the suction part 110 is raised.

In addition, a pivoting part 130 for pivoting the suction part 110 is mounted on the transfer body 120.

The pivoting part 130 includes a first drive motor 131, a first gear 132, and a position sensor 133. The first drive motor 131 is coupled to the first gear 132 for providing a pivoting force to the suction part 110. The first gear 132 is connected to the lower end of the supporting body 112.

The position sensor 133 is for detecting the position of the first gear 132 and may be disposed to face the first gear 132. That is, the position sensor 133 detects whether the suction part 110 connected to the first gear unit 132 has been pivoted. The elevation part 140 checks the pivoted position of the suction part 110 and raises or lowers the suction part 110.

The elevation part 140 is connected to the transfer body 120 and is for raising and lowering the suction part 110 supported by the transfer body 120.

To this end, the elevation part 140 includes a second drive motor 141, a transfer link 142, and a second gear 143. The second gear 143 is coupled to the second drive motor 141 and is for moving the transfer body 120 connected to the transfer link 142 by providing the pivoting force to the transfer link 142.

In addition, the transfer link 142 includes a first transfer link 142*a* and a second transfer link 142*b*, which are connected to the transfer body 120 and the second gear, respectively.

More specifically, one end of the first transfer link 142*a* is connected to the transfer body 120, and the other end of the first transfer link 142*a* is connected to the second transfer link 142*b* via a hinge. In addition, one end of the second transfer link 142*b* is connected to the first transfer link 142*a* via the hinge, and the other end of the second transfer link 142*b* is connected to the second gear 143.

Then, as the first transfer link 142*a* and the second transfer link 142*b* are folded and unfolded, the transfer body 120 is raised up and down.

That is, when the second transfer link 142*b* is rotated clockwise by the driving force of the second drive motor 141 in the forward direction (clockwise in FIG. 2), the transfer body 120 and the suction part 110 are raised accordingly.

On the other hand, when the second transfer link 142*b* is rotated counterclockwise by the driving force of the second drive motor 141 in the reverse direction (counterclockwise in FIG. 2), the transfer body 120 and the suction part 110 are lowered accordingly.

It is to be understood that the elevation part 140 may raise the transfer body 120 by a chain or a gear instead of the link. Specifically, the transfer body 120 may be raised up and down by connecting the transfer body 120 and the second drive motor 141 with a chain as the second drive motor 141 rotates in the forward direction and in the reverse direction.

Alternatively, a plate having a toothed gear (such as a rack gear) may be coupled to the transfer body 120, and the gear of the second drive motor 141 may be engaged with the toothed gear, such that the transfer body 120 may be raised up and down as the second drive motor rotates in the forward direction and in the reverse direction.

Additionally, a position sensor for adjusting the position of the suction part 110, i.e., for detecting the highest position and the lowest position of the suction part 110, may be mounted such that the driving angle of the second drive motor 141 can be controlled.

The connecting duct unit 150 is for flowing the contaminated air through the supporting body 112 to the filtering part 170 and is connected to the supporting body 112.

The connecting duct unit 150 includes a first connecting duct 151 and a second connecting duct 152 so as to be interlocked with the rising up and down of the supporting body 112.

The first connecting duct 151 is inserted into the second connecting duct 152 and is coupled to the second connecting duct 152 so as to be able to be raised up and down to be partially withdrawn from or inserted into the second connecting duct 152.

To this end, the outer diameter of the first connecting duct 151 is smaller than the inner diameter of the second connecting duct 152.

In addition, the second connecting duct 152 is connected to a fan including the fan motor 160, which provides a flow of contaminated air. In addition, the fan motor 160 drives the fan to introduce contaminated air into the suction part and to supply a force to flow the contaminated air to the filtering part 170.

The filtering part 170 is for cleaning contaminated air and includes a filtering part connecting duct 171 connected to the fan motor 160.

In addition, the filtering part 170 may be implemented as a water filter that purifies contaminated air by passing the contaminated air through water.

The user interface 180 (see FIG. 1) is for controlling the operation of the elevating part 140, the pivoting part 130, and the fan motor 160 as a controller. A user may press an on-button for raising and pivoting the suction part 110 and operating the fan motor 160, and may press an off-button for pivoting and lowering the suction part 110 and turning off the fan motor 160. The user may operate the on/off buttons as desired.

The pivoting position of the suction part body 111 may be determined in advance, and the pivoting of the suction part body 111 may be controlled by the user interface so that the suction part body 111 faces the heating devices (two heating devices are depicted in FIG. 1).

Figure 3:
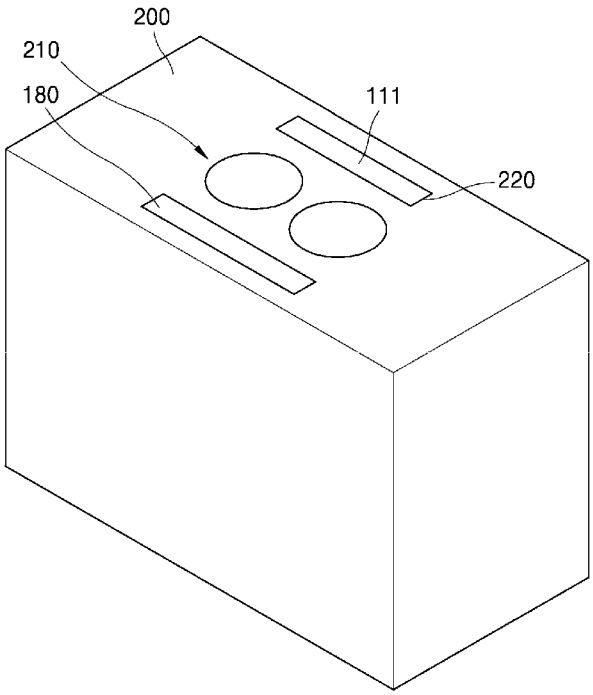
FIG. 3 is a view schematically showing a first position of the downdraft air cleaning unit shown in FIG. 1.
Figure 4:
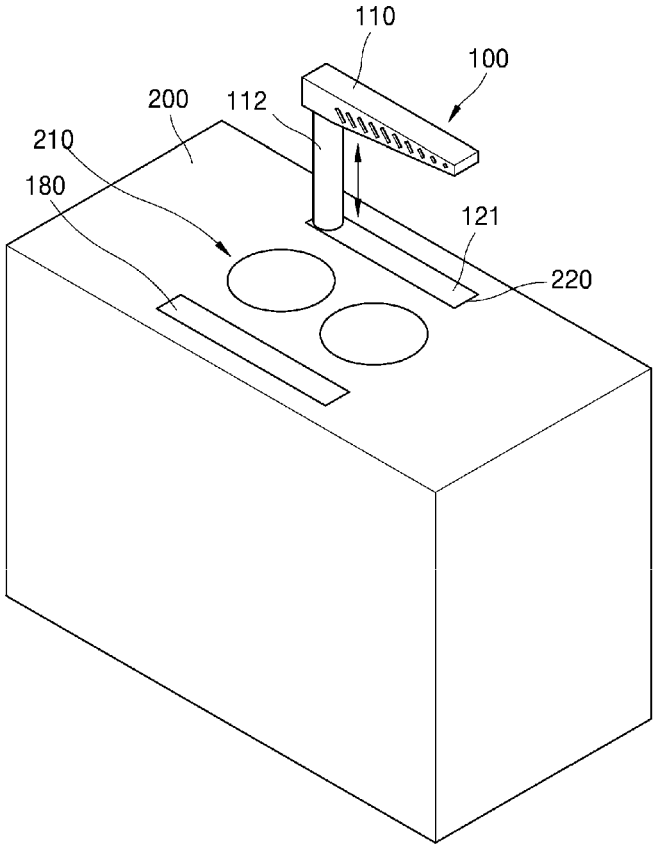
FIG. 4 is a view schematically showing a second position of the downdraft air cleaning unit shown in FIG. 1.
Figure 5:
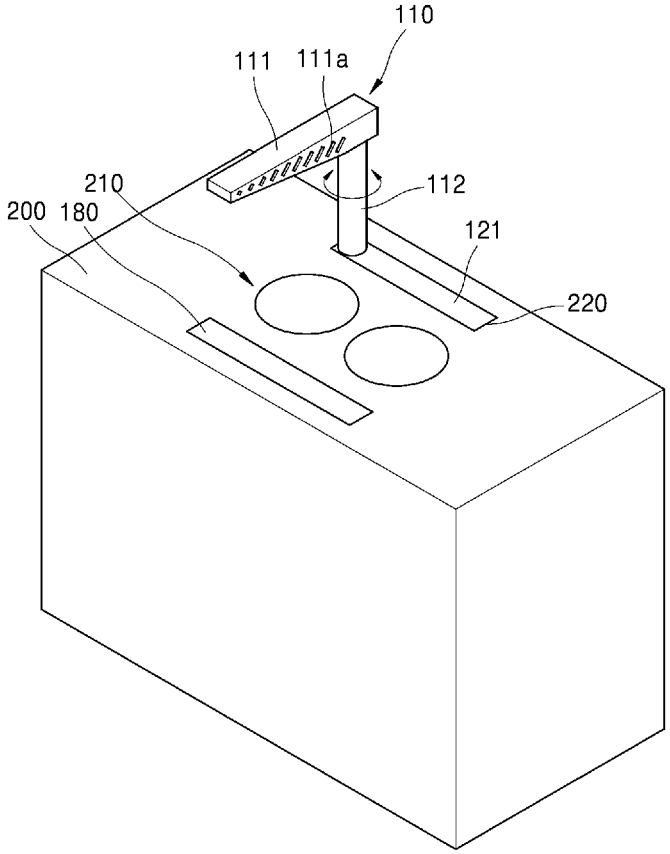
FIG. 5 is a view schematically showing a third position of the downdraft air cleaning unit shown in FIG. 1.

FIGS. 3 to 5 are views schematically showing first, second and third positions of the downdraft air cleaning unit shown in FIG. 1.

More specifically, FIG. 3 shows a position in which the air cleaning unit 100 is not operated such that the suction part body 111 of the suction part 110 is accommodated in the cooking unit 200 and covers the accommodating space 220.

That is, since the suction part 110 is accommodated in the cooking unit 200 before use and is not exposed to the outside, it is less likely to be contaminated and provides a better view and a wider space.

Next, FIG. 4 shows a position in which the suction part 110 of the air cleaning unit 100 is raised for operation. That is, when a user operates the elevation part 140 by the user interface 180, the suction part 110 is raised up.

FIG. 5 shows a position in which the suction part 110 has pivoted. That is, when the user operates the pivoting part 130 through the user interface 180, the suction part 110 pivots so that the inlet holes 111*a* of the suction part body 111 are located adjacent to the heating devices 210. Alternatively, the suction part 110 may be located toward the direction in which the contaminated air flows.

Further, the suction part body 111 may pivot so as to face the direction in which the contaminated air flows.

In addition, the doneness of food can be checked by using the lighting device 111*c* (see FIG. 2) of the suction part body 111.

Figure 6:
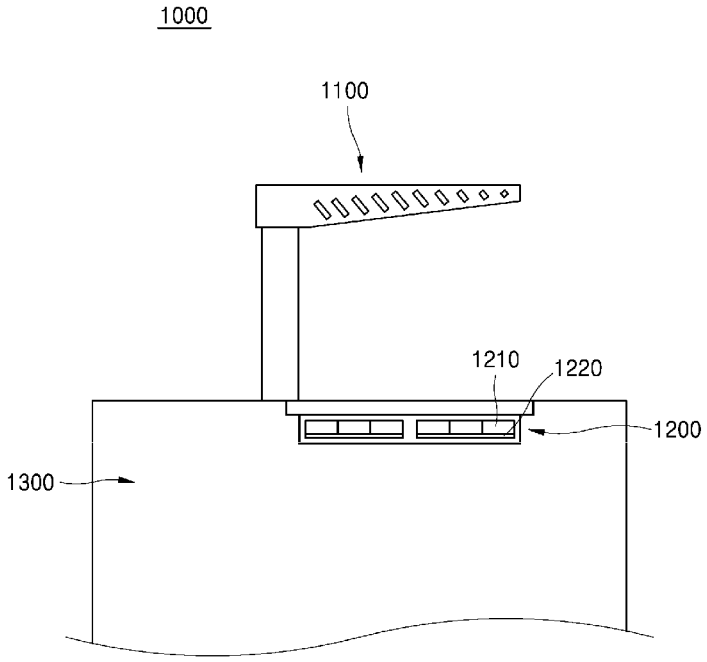
FIG. 6 is a view schematically showing a cooking system including an air cleaning unit according to an exemplary embodiment of the present disclosure.

FIG. 6 is a view schematically showing a cooking system including an air cleaning unit according to an exemplary embodiment of the present disclosure.

As shown in FIG. 6, the cooking system 1000 includes an air cleaning unit 1100, an energy supply module 1200, and a cooking unit 1300.

The energy supply module 1200 may include a wireless power transmission module and/or an eddy-current induction heating module. In the exemplary embodiment shown in FIG. 6, a working coil 1210 that is a wireless power transmission coil is included as the wireless power transmission module, and an inverter 1220 is included for supplying power to the wireless power transmission coil.

The configuration, combination between elements and technical implementation of the air cleaning unit 1100 are identical to those of the air cleaning unit 100 shown in FIG. 2, and, therefore, the redundant description will be omitted.

It should be appreciated that the above-described embodiments are illustrative in all aspects but are not limiting. The scope of the present disclosure is defined only by the appended claims rather than the above-mentioned detailed descriptions. In addition, all modifications or alterations deduced from the spirit and the scope of the claims and equivalents thereof are to be construed as falling within the scope of the present disclosure.

What is claimed is:

1. An air cleaning unit for a cooking unit, the air cleaning unit comprising:

a suction pail configured to receive a flow of contaminated air;

a transfer body coupled with the suction part, the transfer body supporting the suction part;

an elevation part connected to the transfer body, the elevation part configured to raise and lower the transfer body together with the suction part;

a pivoting part connected to the suction part, the pivoting part permitting the suction part to pivot with respect to the transfer body; and a filtering part communicating with the suction part, the filtering part configured to clean the contaminated air introduced into the air cleaning unit through the suction part, wherein the elevation part comprises:

a second drive motor configured to provide a driving force to raise and lower the transfer body;

a second gear coupled with the second drive motor; and a transfer link interlocked with the second gear, the transfer link being configured to be unfolded to thereby raise the transfer body, and to fold up to thereby lower the transfer body, wherein the transfer link comprises:

a first transfer link having a first end connected to the transfer body;

a second transfer link having a first end connected to the second gear; and a hinge coupling a second end of the first transfer link to a second end of the second transfer link, wherein the transfer link is configured to rotate by a driving force in a first direction provided by the second drive motor so that the second transfer link is unfolded from the first transfer link, and thereby the transfer body and the suction part are elevated, wherein the transfer link is further configured to rotate by a driving force in a second direction provided by the second drive motor, the second direction being opposite to the first direction so that the second transfer link is folded with the first transfer link, and thereby the transfer body and the suction part are lowered, wherein the air cleaning unit further comprises a connecting duct unit to provide an airflow conduit for contaminated air between the suction part and the filtering part, wherein the connecting duct unit comprises:

a first connecting duct coupled to a supporting body of the suction part; and a second connecting duct coupled with the filtering part, and wherein one of the first connecting duct and the second connection duct is inserted into an other of the first connecting duct and the second connection duct to provide extensibility of the connecting duct unit as the first connecting duct is raised and lowered together with the suction part, wherein the suction part comprises:

a suction part body, the suction part body including:

a plurality of inlet holes through which the contaminated air is sucked; and a lighting device;

wherein the supporting body is coupled under one side of the suction part body, the supporting body providing an airflow conduit for contaminated air introduced through the inlet holes, wherein an upper end of the supporting body is coupled with the suction part body, and a lower end of the supporting body is pivotably supported by the transfer body, and wherein the suction part body is received in an accommodating space when in a lowered position, and wherein the transfer body comprises a plate configured to cover the accommodating space when the suction part body is in an elevated position.

2. The air cleaning unit of claim 1, wherein the filtering part comprises a water filter for cleaning the contaminated air with water.

3. The air cleaning unit of claim 1 wherein the pivoting part is provided on the transfer body, and wherein the pivoting part comprises:

a first drive motor configured to provide a rotating force to the suction part; and a first gear connected to the first drive motor and connected to a lower end of the supporting body.

4. The air cleaning unit of claim 3, wherein the pivoting part further comprises a position sensor facing the first gear, the position sensor being configured to detect a position of the first gear.

5. The air cleaning unit of claim 1, further comprising a fan including a fan motor configured to provide a force to flow the contaminated air into the suction part and to the filtering part.

6. The air cleaning unit of claim 5, further comprising a filtering part connecting duct connected between the fan and the filtering part.

7. The air cleaning unit of claim 1, further comprising a user interface including a controller configured to operate the elevation part, the pivoting part and a fan motor configured to provide a force to flow the contaminated air.

8. A cooking system comprising:

a cooking unit;

an energy supply module provided to the cooking unit; and an air cleaning unit accommodated by the cooking unit, wherein the air cleaning unit comprises:

a suction part configured to receive a flow of contaminated air;

a transfer body coupled with the suction part, the transfer body supporting the suction part;

an elevation part connected to the transfer body, the elevation part configured to raise and lower the transfer body together with the suction part;

a pivoting part connected to the suction part, the pivoting part permitting the suction part to pivot with respect to the transfer body; and a filtering part communicating with the suction part, the filtering part configured to clean the contaminated air introduced into the air cleaning unit through the suction part, wherein the elevation part comprises:

a second drive motor configured to provide a driving force to raise and lower the transfer body;

a second gear coupled with the second drive motor; and a transfer link interlocked with the second gear, the transfer link being configured to be unfolded to thereby raise the transfer body, and to fold up to thereby lower the transfer body, wherein the transfer link comprises:

a first transfer link having a first end connected to the transfer body;

a second transfer link having a first end connected to the second gear; and a hinge coupling a second end of the first transfer link to a second end of the second transfer link, wherein the transfer link is configured to rotate by a driving force in a first direction provided by the second drive motor so that the second transfer link is unfolded from the first transfer link, and thereby the transfer body and the suction part are elevated, wherein the transfer link is further configured to rotate by a driving force in a second direction provided by the second drive motor, the second direction being opposite to the first direction so that the second transfer link is folded with the first transfer link, and thereby the transfer body and the suction part are lowered, wherein the cooking system further comprises a connecting duct unit to provide an airflow conduit for contaminated air between the suction part and the filtering part, wherein the connecting duct unit comprises:

a first connecting duct coupled to a supporting body of the suction part; and a second connecting duct coupled with the filtering part, wherein one of the first connecting duct and the second connection duct is inserted into an other of the first connecting duct and the second connection duct to provide extensibility of the connecting duct unit as the first connecting duct is raised and lowered together with the suction part, wherein an upper end of the supporting body is coupled with the suction part body, and a lower end of the supporting body is pivotably supported by the transfer body, wherein the suction part body is received in an accommodating space when in a lowered position, and wherein the transfer body comprises a plate configured to cover the accommodating space when the suction part body is in an elevated position.

9. The cooking system of claim 8, wherein the energy supply module comprises a wireless power transmission module and/or an eddy-current induction heating module.

10. A cooking unit comprising:

a suction part configured to receive a flow of contaminated air, the suction part including a suction part body, the suction part body including:

a plurality of inlet holes provided on at least one side of the suction part body and through which the contaminated air is sucked; and a lighting device provided on a bottom of the suction part body to illuminate an area below the suction part body;

a transfer body coupled with the suction part;

a filtering part communicating with the suction part;

an elevation part configured to raise and lower the suction part; and a pivoting part configured to pivot the suction part, wherein the suction part body is received in an accommodating space when the suction part body is in a lowered position, wherein the transfer body comprises a plate configured to cover the accommodating space when the suction part body is in an elevated position, wherein the elevation part comprises:

a second drive motor configured to provide a driving force to raise and lower the transfer body;

a second gear coupled with the second drive motor; and a transfer link interlocked with the second gear, the transfer link being configured to be unfolded to thereby raise the transfer body, and to fold up to thereby lower the transfer body, wherein the transfer link comprises:

a first transfer link having a first end connected to the transfer body;

a second transfer link having a first end connected to the second gear; and a hinge coupling a second end of the first transfer link to a second end of the second transfer link, wherein the transfer link is configured to rotate by a driving force in a first direction provided by the second drive motor so that the second transfer link is unfolded from the first transfer link, and thereby the transfer body and the suction part are elevated, wherein the transfer link is further configured to rotate by a driving force in a second direction provided by the second drive motor, the second direction being opposite to the first direction so that the second transfer link is folded with the first transfer link, and thereby the transfer body and the suction part are lowered, wherein the cooking unit further comprises a connecting duct unit to provide an airflow conduit for contaminated air between the suction part and the filtering part, wherein the connecting duct unit comprises:

a first connecting duct coupled to a supporting body of the suction part; and a second connecting duct coupled with the filtering part, wherein one of the first connecting duct and the second connection duct is inserted into an other of the first connecting duct and the second connection duct to provide extensibility of the connecting duct unit as the first connecting duct is raised and lowered together with the suction part, and wherein an upper end of the supporting body is coupled with the suction part body, and a lower end of the supporting body is pivotably supported by the transfer body.

11. The cooking unit of claim 10, further comprising:

a first drive motor configured to provide a rotating force to pivot the suction part.

* * * * *